US011398680B2

(12) United States Patent
Mak et al.

(10) Patent No.: US 11,398,680 B2
(45) Date of Patent: Jul. 26, 2022

(54) DIRECTIONAL CURVED ANTENNA

(71) Applicant: STAR Systems International Limited, Kwai Chung (HK)

(72) Inventors: Chi Lun Mak, Hong Kong (HK); Stephen Christopher Lockhart, Allen, TX (US)

(73) Assignee: STAR SYSTEMS INTERNATIONAL LIMITED, Kwai Chung (HK)

( * ) Notice: Subject to any disclaimer, the term of this patent is extended or adjusted under 35 U.S.C. 154(b) by 0 days.

(21) Appl. No.: 16/882,069

(22) Filed: May 22, 2020

(65) Prior Publication Data

US 2021/0367343 A1 Nov. 25, 2021

(51) Int. Cl.

| | |
|---|---|
| ***H01Q 9/04*** | (2006.01) |
| ***H01Q 1/42*** | (2006.01) |
| ***H01Q 1/12*** | (2006.01) |
| ***H01Q 21/08*** | (2006.01) |
| *H01Q 1/22* | (2006.01) |

(52) U.S. Cl.

CPC ..... *H01Q 9/0471* (2013.01); *H01Q 1/1242* (2013.01); *H01Q 1/42* (2013.01); *H01Q 21/08* (2013.01); *H01Q 1/2216* (2013.01)

(58) Field of Classification Search

CPC ..... H01Q 1/1242; H01Q 9/0471; H01Q 21/08
See application file for complete search history.

(56) References Cited

U.S. PATENT DOCUMENTS

| | | | | |
|---|---|---|---|---|
| 4,816,836 | A * | 3/1989 | Lalezari | H01Q 21/065 156/215 |
| 5,437,091 | A * | 8/1995 | Norman | H01Q 9/0471 29/600 |
| 5,734,350 | A * | 3/1998 | Deming | H01Q 1/42 343/700 MS |
| 6,067,054 | A * | 5/2000 | Johannisson | H01Q 1/125 343/814 |
| 10,572,703 | B1 * | 2/2020 | Shyamkumar | H01Q 1/2216 |
| 2005/0168385 | A1 * | 8/2005 | Baker | H01Q 1/1242 343/700 MS |
| 2007/0052521 | A1 * | 3/2007 | Beedies | G08B 13/2474 340/10.1 |
| 2007/0273531 | A1 * | 11/2007 | Ando | H01Q 1/2216 340/572.7 |
| 2011/0298669 | A1 | 12/2011 | Rao et al. | |

(Continued)

FOREIGN PATENT DOCUMENTS

| | | | |
|---|---|---|---|
| CN | 102646864 | A | 8/2012 |
| CN | 108321518 | A | 7/2018 |

(Continued)

OTHER PUBLICATIONS

International Search Report dated Jul. 21, 2021 in PCT/CN2021/089177, 8 pages.

*Primary Examiner* — Ab Salam Alkassim, Jr.
(74) *Attorney, Agent, or Firm* — Muncy, Geissler, Olds & Lowe, P.C.

(57) ABSTRACT

A directional curved antenna, comprising: a feed network; a curved ground plane; at least two radiating elements connected to the feed network above the curved ground plane, wherein the at least two radiating elements are arranged and configured such that the directional curved antenna provides a directional radiation.

16 Claims, 16 Drawing Sheets

(56) References Cited

U.S. PATENT DOCUMENTS

| | | | | |
|---|---|---|---|---|
| 2012/0026054 | A1* | 2/2012 | Liu | H01Q 21/0075 343/824 |
| 2016/0042206 | A1* | 2/2016 | Pesavento | G06K 7/10178 235/385 |
| 2016/0173183 | A1* | 6/2016 | Kang | H01Q 25/00 455/562.1 |
| 2017/0069950 | A1* | 3/2017 | Kim | H01Q 9/04 |
| 2017/0104267 | A1* | 4/2017 | Powell | H01Q 21/061 |
| 2018/0173908 | A1* | 6/2018 | Pretorius | H01Q 9/0421 |
| 2018/0366809 | A1* | 12/2018 | Jang | H01Q 1/1228 |
| 2020/0321697 | A1* | 10/2020 | Zimmerman | H01Q 21/26 |
| 2020/0364421 | A1* | 11/2020 | Wappler | H01Q 1/2216 |
| 2021/0242563 | A1* | 8/2021 | Venture | G06Q 10/08 |

FOREIGN PATENT DOCUMENTS

| | | | |
|---|---|---|---|
| CN | 109768386 | A | 5/2019 |
| WO | WO-2015/120904 | A1 | 8/2015 |

* cited by examiner

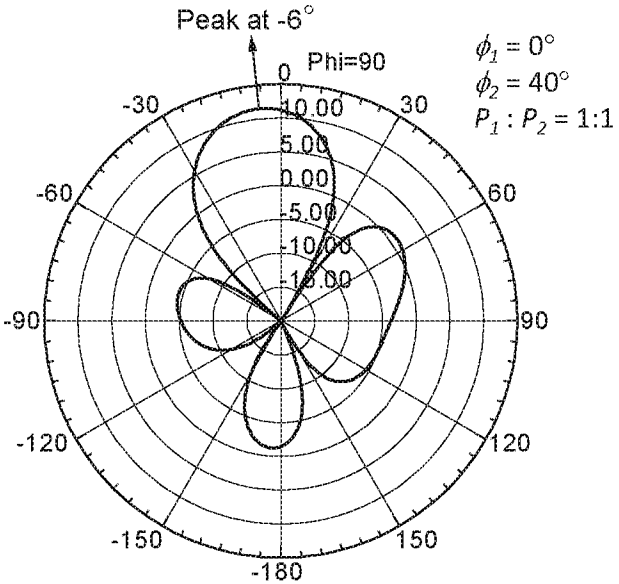
Figure 5D
Figure 5E
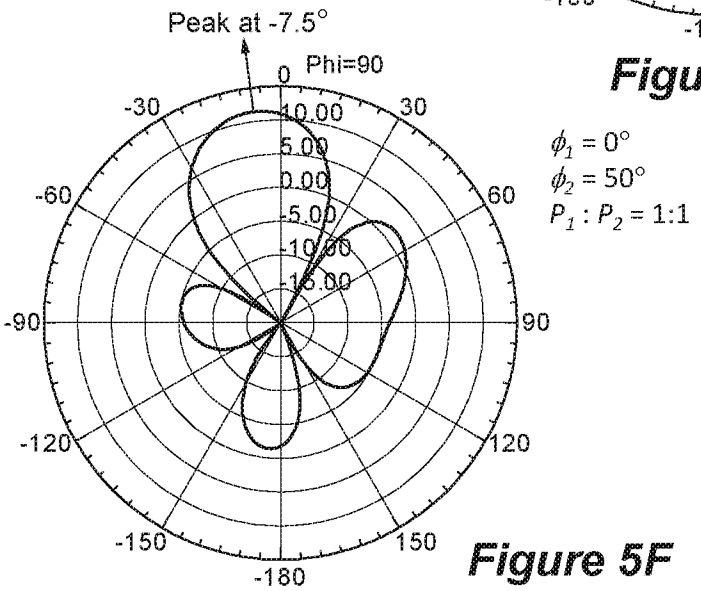
Figure 5F

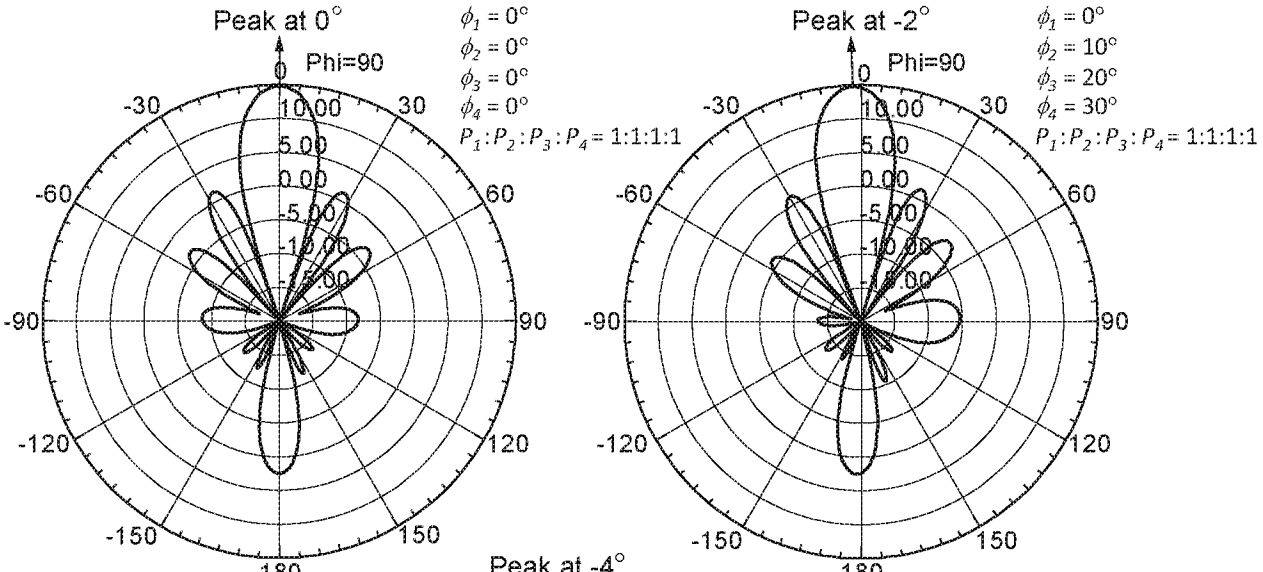
Figure 10A
Figure 10B
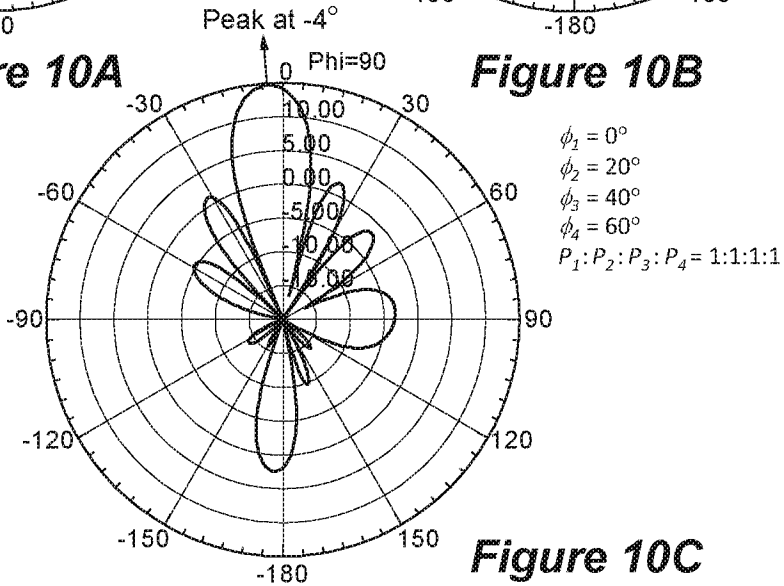
Figure 10C
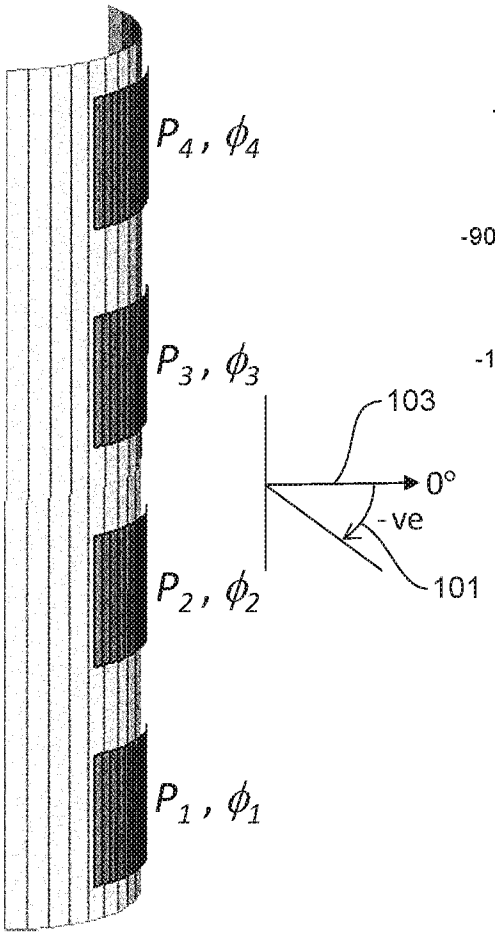
Figure 9

DIRECTIONAL CURVED ANTENNA

TECHNICAL FIELD

The present disclosure relates to a curved antenna. In particular, it relates to a directional curved antenna.

BACKGROUND

Radio Frequency Identification (RFID) is a technique used to identify objects by means of electromagnetic waves or radio frequency. An object can be tagged with an electronic code responding label. An electronic code responding label comprises an antenna and an integrated circuit. Apart from the conventional logistics and supply chain industries, RFID is an emerging technology in different industries for many applications such as Automatic Vehicle Identification (AVI) systems or Electronic Toll Collection (ETC) systems, traffic management, smart cities, etc.

In practice, RFID provides a quick and affordable means to identify objects. Upon receiving a valid interrogating signal from an interrogating source, such as from an interrogating antenna (or transmitting and receiving antenna) of an RFID reader, the electronic code responding label responds according to its designed protocol. As the electronic code responding label has an unique identification code which relates to the object that the electronic code responding label is attached to, by communicating with the electronic code responding label to retrieve the unique identification code representing the object, one can identify the presence of the object simply by identifying the presence of the electronic code responding label. An electronic code responding label sometimes is known as a label, a tag, an inlay, or a transponder, etc.

Common operating frequency range of RFID includes LF band, HF band, UHF band, and microwave band. The global UHF RFID frequency band covers 860-960 MHz. For Europe, the ETSI band covers 865-868 MHz. In US, the FCC band covers 902-928 MHz.

A patch antenna is also known as a microstrip antenna or a printed antenna. It is widely used nowadays especially in the wireless communications industries. A patch antenna is low cost, low in profile, and easily fabricated, which may be mounted on a flat or curved surface. It usually comprises a piece of sheet or "patch" of metal of different sizes and shapes, mounted over a larger sheet of metal called a ground plane. The "patch" of a patch antenna acts as the radiating element of the patch antenna. It may be realized by using a standalone metallic plate or printed directly onto a Printed Circuit Board (PCB). A patch antenna can be used as the antenna of an electronic code responding label or as the antenna of the interrogating antenna of an RFID reader.

The structure of a basic patch antenna comprises a radiating element, a ground plane, a dielectric substrate, and a feed point. As mentioned previously, a radiating element may be a metal plate of any size and any shape as long as it suits the implementation of the antenna depending on its application. A ground plane is often a metal sheet larger than the radiating element, and a dielectric substrate is positioned between the ground plane and the radiating element. In some cases, a patch antenna may be without a ground plane. It may utilise a conductive surface, though not ideal and rare, where the patch antenna is attached to, as its ground plane. A feed point is where a signal is fed in or received from the radiating element. There are many different feeding or excitation methods comprising, but not limited to, probe-fed and edge-fed methods.

The design and placement of one or more interrogating antennas of an RFID reader is crucial in the overall performance of an RFID system. Each of the interrogating antennas is often designed to have a directional and focused radiation beamwidth that covers a desired area of interest. In some applications, for example the application in an ETC system, the radiation beamwidth should not be too wide or it may read more than one vehicle through their respective RFID transponders, but should not be too narrow as well or no vehicle may be identified. The radiation beam of an interrogating antenna is focused in a particular direction, and it is usually by mechanical means. For instance, a mounting bracket with mechanical tilting structure. Common locations for mounting reader antennas in Electronic Toll Collection applications are highway gantries, or cantilevers, such that the antenna is mounted horizontally and facing downward to the ground (sometimes known as the Earth plane), or to the road, and towards approaching traffic.

The present disclosure provides an alternative design of the interrogating antenna which is curved in structure and with characteristics described with greater details in this specification.

SUMMARY

According to a first aspect of the present disclosure, there is provided a directional curved antenna, comprising: a feed network; a curved ground plane; at least two radiating elements connected to the feed network above the curved ground plane, wherein the at least two radiating elements are arranged and configured such that the directional curved antenna provides a directional radiation.

In one form, the directional radiation is with its main beam directed towards an Earth plane. In one form, the curved ground plane is positioned perpendicular to an Earth plane. In one form, the directional curved antenna is mounted at a curved side of a column. In one form, the curved ground plane follows the curvature of the curved side of the column. In one form, the at least two radiating elements are arranged longitudinally along the column.

In one form, the at least two radiating elements are on a same plane and positioned perpendicular to the Earth plane. In one form, the at least two radiating elements are curved radiating elements. In one form, the at least two radiating elements are positioned at different altitudes with respect to an Earth plane. In one form, the directional radiation is narrower in beamwidth in a vertical plane than in a horizontal plane.

In one form, the directional curved antenna further comprises a curved radome for covering the feed network, the curved ground plane, and the at least two radiating elements. In one form, the curved radome provides an inconspicuous effect to the curved antenna.

In one form, the directional curved antenna further comprises an adjusting mechanism for adjusting a tilt angle of a main beam of the directional radiation of the directional curved antenna. In one form, the directional curved antenna is adjustable with respect to a structure the directional curved antenna is mounted on. In one form, the at least two radiating elements are adjustable in position to adjust the separation between them. In one form, the feed network provides phase differences, or power differences, or both, between the at least two radiating elements. In one form, a tilt angle of a main beam of the directional radiation is adjustable by adjusting the feed network, or a relative position of the at least two radiating elements, or both. In one form, the directional curved antenna further comprises a substrate between the curved ground plane and the at least two radiating elements, wherein the curved ground plane increases an effective thickness of the substrate as compared with a flat ground plane.

BRIEF DESCRIPTION OF DRAWINGS

Embodiments of the present disclosure will be discussed with reference to the accompanying drawings wherein:

FIGS. 5A to 5I present simulated results of a 2D radiation pattern of the curved antenna of FIG. 1A;

FIG. 9 shows the curved antenna of FIG. 6A with a reference line and reference angle;

FIGS. 10A to 10F present simulated results of a 2D radiation pattern of the curved antenna of FIG. 6A;

DESCRIPTION OF EMBODIMENTS

Figure 1B:
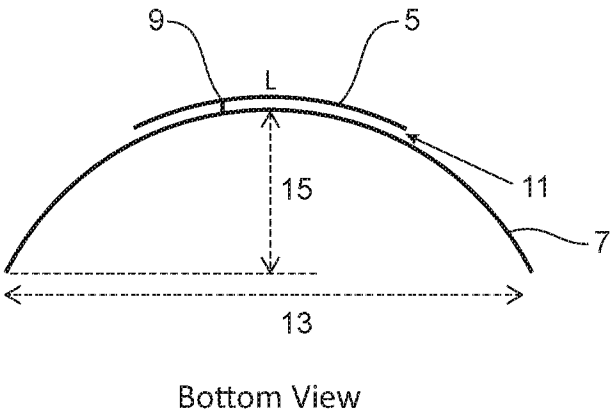
FIGS. 1A and 1B depict one exemplary embodiment of a patch antenna of the present disclosure.

The present disclosure introduces a novel and inventive curved antenna. While its main design purpose is for use as an interrogating antenna of an RFID reader, it can also be used as an antenna for other purposes when the control of directionality or a curved geometry or both are desired.

In a broad form, the curved antenna is a directional curved antenna. It comprises a feed network, a curved ground plane, and at least two radiating elements connected to the feed network and positioned above the curved ground plane. The at least two radiating elements are arranged and configured such that the directional curved antenna provides a directional radiation.

The term "directional radiation" should be understood to be non-omnidirectional radiation. True omnidirectional radiation is radiated by a point source which radiates equal radio power in all directions in 3D space. True omnidirectional radiation does not exist in the real world. In practice, some people may define omnidirectional radiation as radiated by an omnidirectional antenna which radiates equal radio power in all directions perpendicular to an axis (azimuthal directions), with power varying with angle to the axis (elevation angle), declining to zero on the axis. Accordingly, directional radiation would be radiation that is unequal in radio power in all directions. In simple terms, directional radiation is focused radiation, in that the best sensitivity is in a certain direction, but not all directions. In an ideal case, a directional antenna is designed to radiate most of its power in the lobe directed in the desired direction.

The term "curved" should be understood literally to mean not flat, i.e. a "curved" plane refers to a spatial geometry which is not "flat". It does not need to be symmetrical. It also does not need to be a perfectly smooth surface. For example, a curved antenna may be formed by a few straight segments forming an imperfect curve, albeit not perfectly curved. Note that this is distinctive from having multiple individual flat patch antennas, each with their own feed point. An imperfect curve requires each straight segment to be connected electrically and share only a single feed point.

The term "radiating elements" refers to basic subdivision of an antenna which is designed to support the radio-frequency currents or fields that contribute directly to the radiation pattern of the antenna. In relation to a patch antenna, the radiating elements are the patches of the patch antenna. Radiating elements may also take the form of elongated rods (such as rods in a typical dipole antenna). Other forms may also be possible as long as the radiation elements are able to interact with a corresponding ground plane to act as an antenna and radiate.

The term "feed network" refers to the part between the antenna feed and individual feed points of all the radiating elements. It is usually constructed with a waveguide including microstrip line, electrical wire or cabling, etc. The feed network often, but not necessarily perfectly, matches the radiating elements to the wire or cabling.

The term "ground plane" refers to a conducting surface that serves as part of an antenna, to reflect the radio waves from the other antenna elements. The plane is conductive but does not necessarily have to be connected to the ground. It also does not need to be flat or nearly flat horizontally. It may be a curved surface. It is not necessarily a smooth surface.

Figure 1A:
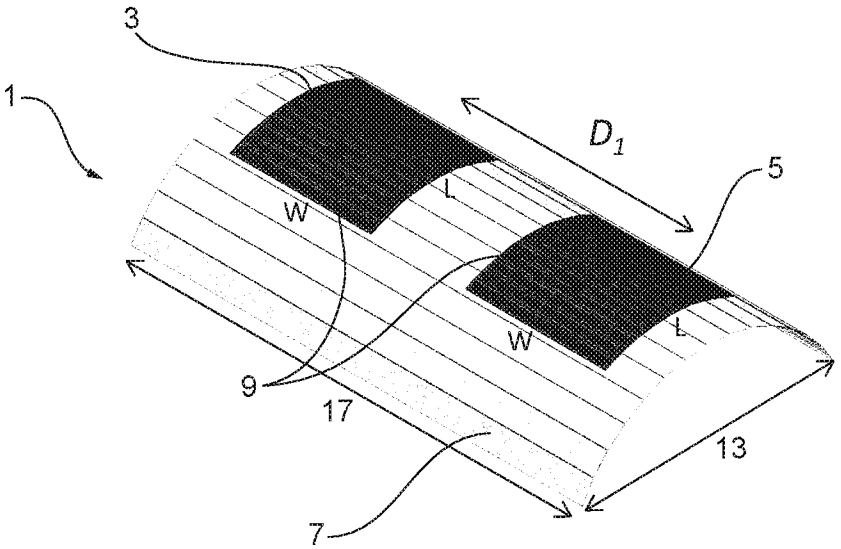

FIG. 1A depicts one embodiment of the present disclosure. In this embodiment, there is provided a curved antenna 1 comprising two curved patches 3, 5 on a curved ground plane 7. Each of the two curved patches 3, 5 are connected to a respective individual feed point 9 into a feeding network (not shown in FIG. 1A). FIG. 1B depicts a bottom view of the embodiment of FIG. 1A. Between each of the two curved patches 3, 5 and the curved ground plane 7, there is a layer of substrate 11.

In this example, each patch is measured 141.34 mm (L)×149 mm (W). The distance between the two curved patches $D_1$, is 250 mm. The substrate 11 is an air substrate of 7 mm thickness. The side edge 17 of the curved ground plane 7 is 480 mm. When bent into a curve, the distance 13 between the two side edges is 267.3 mm. The distance 15 between the peak of the curve and the base is 81.9 mm.

The substrate 11 may take other forms. For example, it can be a dielectric material or multiple dielectric materials together with air substrate.

It was found that having a curved ground plane would increase the effective thickness of a substrate between the curved ground plane and radiating elements (which take the form of radiating patches in the embodiment of FIG. 1A). In other words, comparing a patch antenna with a flat ground plane and a patch antenna with a curved ground plane, both with the same feed probe length, the effective thickness of the substrate of the antenna with a curved ground plane is thicker. This is a desired effect. In general, a thicker substrate in patch antenna design may enhance the performance such as operating bandwidth and gain of the patch antenna.

Figure 2:
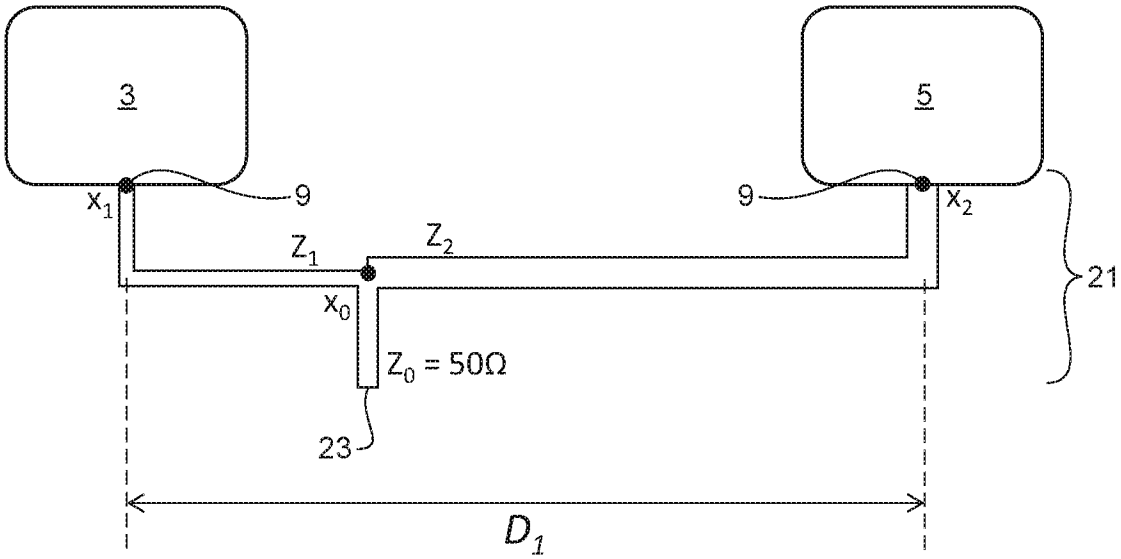
FIG. 2 shows an exemplary feed network for the embodiment of FIG. 1A.

FIG. 2 shows an exemplary feed network (microstrip line feed network) for the embodiment of FIG. 1A. In this example, the feed network 21 is between the individual feed points 9 and antenna feed 23. Antenna feed 23 usually have a characteristic impedance $Z_0$ of 50Ω.

Exemplary design steps of the feed network 21 are provided below.

Let:

Total length of path $X_0$ to $X_1$=$X_0X_1$;

Total length of path $X_0$ to $X_2$=$X_0X_2$;

Phase difference ($\phi_1-\phi_2$) depends on the path length difference ($X_0X_1-X_0X_2$);

Power ratio ($P_1/P_2$) depends on the ratio of ($Z_2/Z_1$) at $X_0$;

$Z_1$, $Z_2$ are impedances of microstrip line at $X_0$ towards $X_1$ and towards $X_2$ respectively;

then the electrical tilting angle is a function of phase difference: $\phi_1-\phi_2$, power ratio $P_1/P_2$, and $D_1$.

With these, the feed network may provide phase differences, or power differences, or both, between the at least two radiating elements to control an electrical tilting angle of the directional radiation of the proposed curved antenna.

Figure 3:
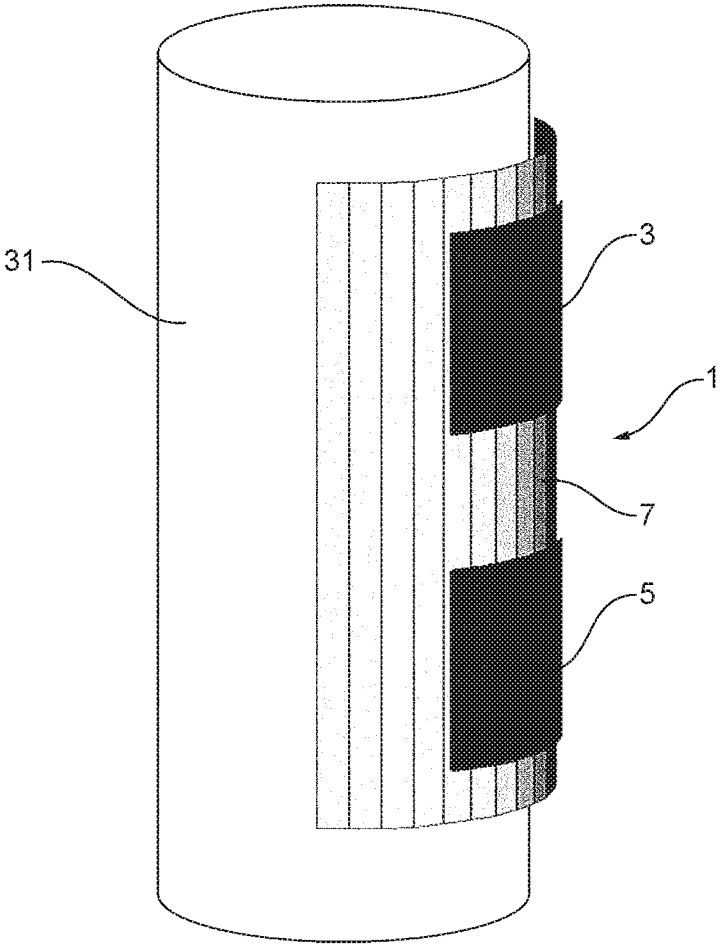
FIG. 3 depicts an application of the curved antenna of FIG. 1A.

FIG. 3 depicts an application of the curved antenna of FIG. 1A on a column where the curved antenna is mounted at a curved side of a column. In this example, the column is a vertical column 31. In such a case, the curved antenna 1 is positioned perpendicularly to the Earth plane with its curved patches 3, 5 and curved ground plane 7 also positioned perpendicularly to the Earth plane.

With tuning of the parameters of $D_1$, phase difference ($\phi_1-\phi_2$), power ratio ($P_1/P_2$), electrical tilting (down-tilt or up-tilt of radiation) can be achieved. Therefore, the curved antenna can always keep straight upright even if a tilting radiation pattern is needed.

In another embodiment, the column is with an angle with respect to the Earth plane. In another embodiment, the curved antenna is substantially horizontal when mounted, for example, when mounted on a horizontal overhead portion of an overhead traffic light support.

As can be seen from FIG. 3, the curved antenna 1 is with its curved patches 3, 5 and curved ground plane 7 following the curvature of the curved side of the column 31. However, this is not necessarily so, and the following are examples of different possible variations:

a. Curved ground plane; curved patches; only the curved ground plane following the curvature of the curved side of the column;
b. Curved ground plane; flat patches; the curved ground plane following the curvature of the curved side of the column;
c. Curved ground plane; curved patches; none of them following the curvature of the curved side of the column;

Further, as seen from FIGS. 1A and 3, the two curved patches 3, 5 are arranged longitudinally along the vertical column 31, with one directly on top of the other, and with both on a same plane. The term "longitudinally" means along the elongated direction of the column. In a different embodiment, the two curved patches 3, 5 need not be arranged with one directly on top of the other. In yet another embodiment, the two curved patches 3, 5 need not be arranged on a same plane. In the embodiment of FIGS. 1A and 3, when the curved antenna 1 is mounted on the vertical column 31, the at least two curved patches 3, 5 are positioned at different altitudes with respect to the Earth plane. Of course, when the same curved antenna 1 is applied on a horizontal support, such as the horizontal support of an overhead traffic light, the at least two curved patches 3, 5 would be at a same altitude.

Figure 4:
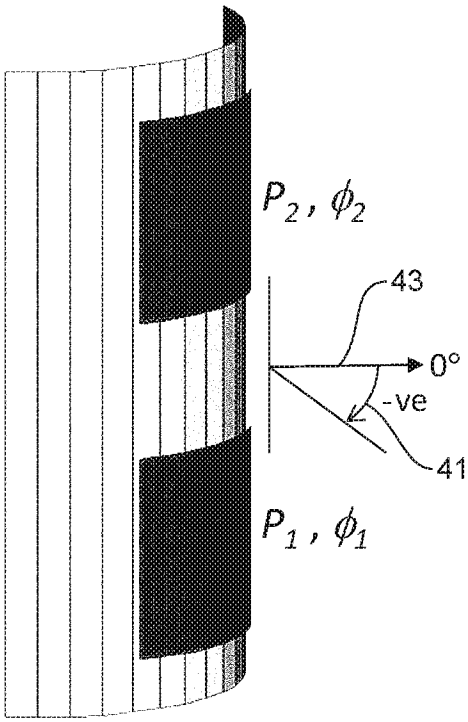
FIG. 4 shows the curved antenna of FIG. 1A with a reference line and reference angle.
Figure 5H:
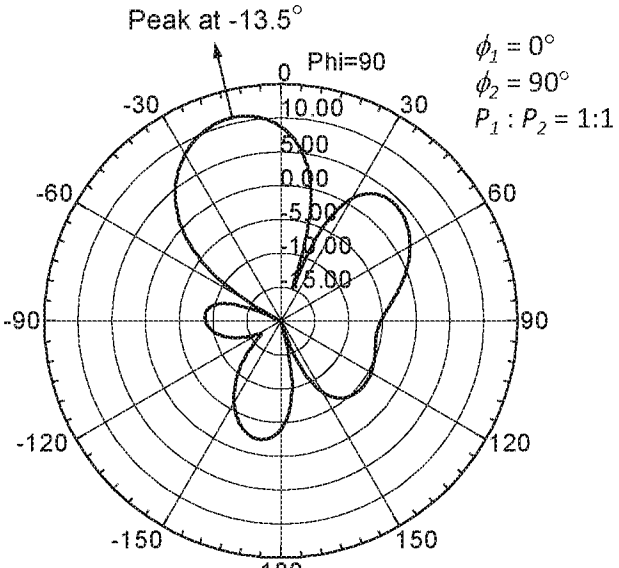
Figure 5G:
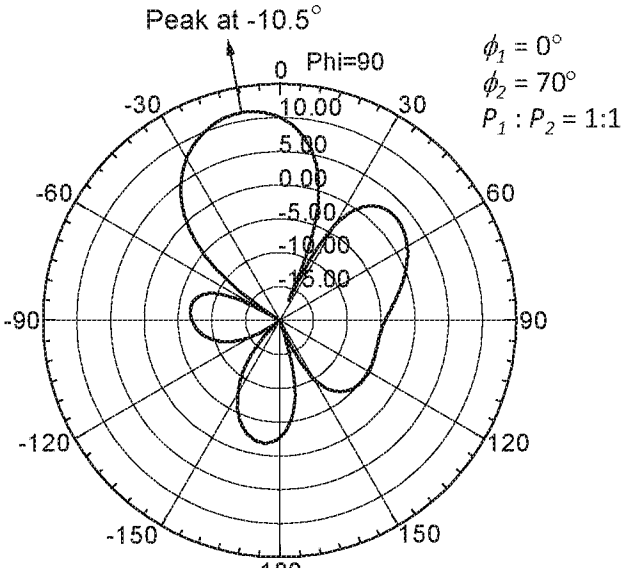
Figure 5I:
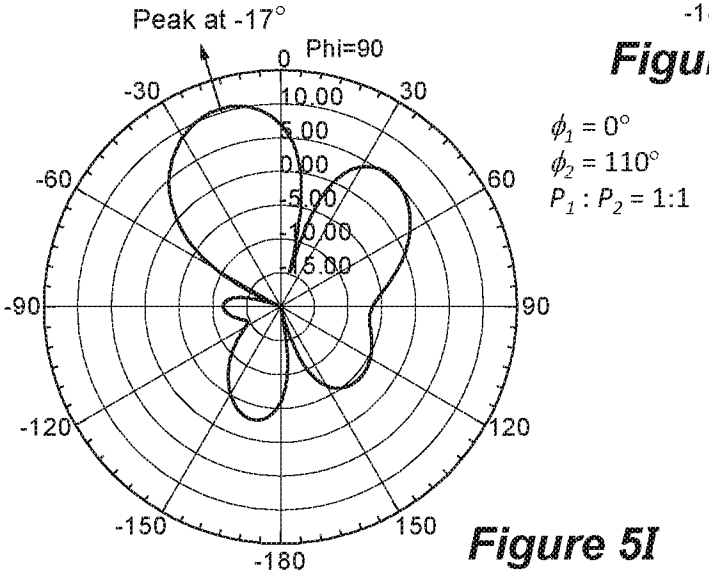

FIG. 4 shows the curved antenna 1 of FIG. 1A, and provides a reference angle, θ, 41 and a reference line 43. The reference line 43 is orthogonal to the ground plane 7 of the curved antenna 1. The reference angle, θ, 41 refers to the angle of the main radiation of the curved antenna relative to the reference line 43. For simplicity, a direction below the reference line 43 is considered to be a negative angle in the following examples.

Figure 5A:
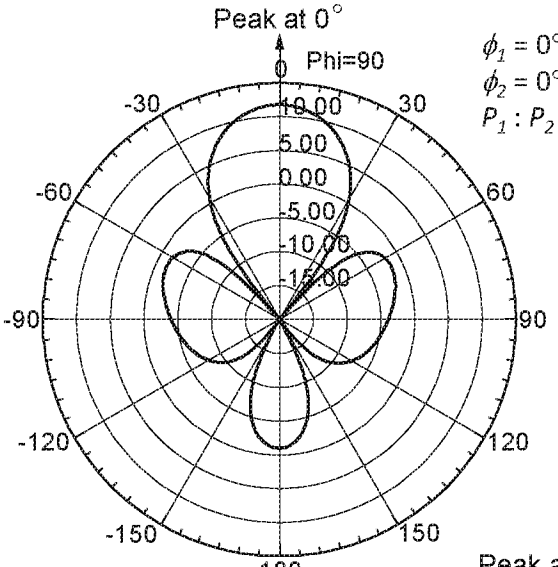
Figure 5B:
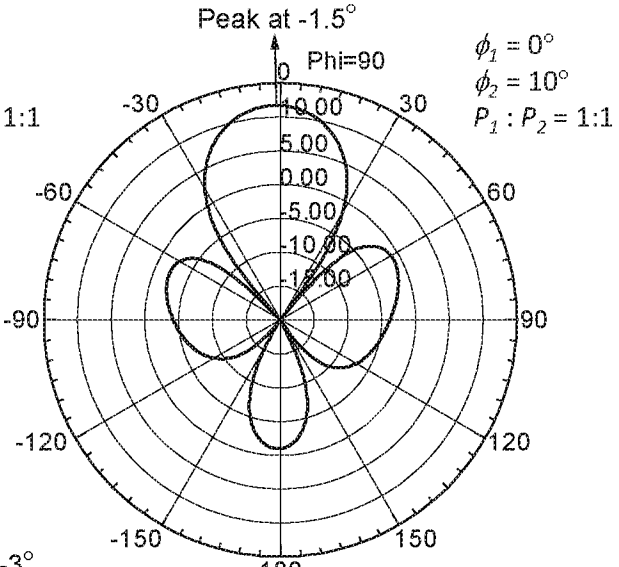
Figure 5C:
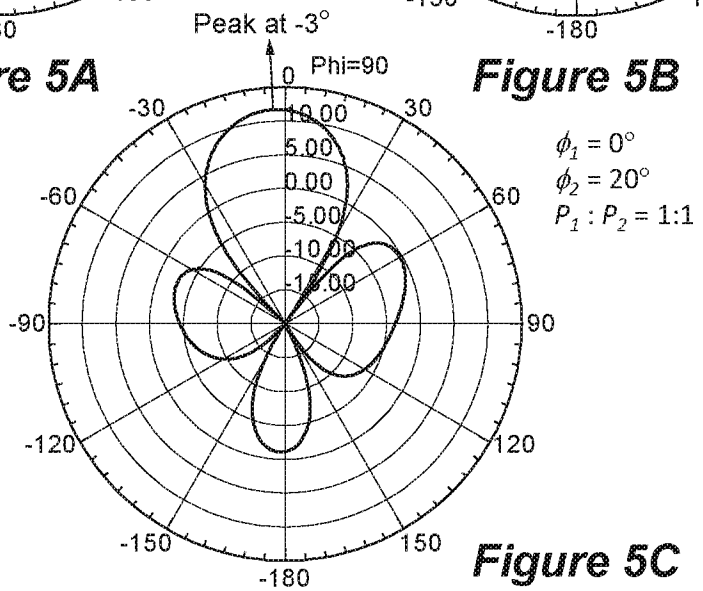

FIGS. 5A to 5I present simulated results of a 2D radiation pattern at a vertical plane with the reference line 43 falling along the vertical plane. Note that in those simulated results, the top direction corresponds to the direction of the reference line 43. FIG. 5A shows that when $\phi_1=\phi_2=0°$, and that $P_1:P_2=1:1$, the main directional radiation is at 0° with relative to the reference line 43, i.e. there is no electrical tilting. FIG. 5B shows that when $\phi_1=0°$, $\phi_2=10°$, and that $P_1:P_2=1:1$, the main directional radiation is at −1.5° with relative to the reference line 43, i.e. there is an electrical tilting of 1.5° towards the Earth plane. FIG. 5C shows that when $\phi_1=0°$, $\phi_2=20°$, and that $P_1:P_2=1:1$, the main directional radiation is at −3° with relative to the reference line 43, i.e. there is an electrical tilting of 3° towards the Earth plane. FIG. 5D shows that when $\phi_1=0°$, $\phi_2=30°$, and that $P_1:P_2=1:1$, the main directional radiation is at −4.5° with relative to the reference line 43, i.e. there is an electrical tilting of 4.5° towards the Earth plane. FIG. 5E shows that when $\phi_1=0°$, $\phi_2=40°$, and that $P_1:P_2=1:1$, the main directional radiation is at −6° with relative to the reference line 43, i.e. there is an electrical tilting of 6° towards the Earth plane. FIG. 5F shows that when $\phi_1=0°$, $\phi_2=50°$, and that $P_1:P_2=1:1$, the main directional radiation is at −7.5° with relative to the reference line 43, i.e. there is an electrical tilting of 7.5° towards the Earth plane.

The results of 5G to 5I, together with the results of 5A to 5F are summarised in the table below:

| FIG. | $\phi_1$ | $\phi_2$ | $P_1:P_2$ | θ |
|---|---|---|---|---|
| 5A | 0° | 0° | 1:1 | 0° |
| 5B | 0° | 10° | 1:1 | −1.5° |
| 5C | 0° | 20° | 1:1 | −3° |
| 5D | 0° | 30° | 1:1 | −4.5° |
| 5E | 0° | 40° | 1:1 | −6° |
| 5F | 0° | 50° | 1:1 | −7.5° |
| 5G | 0° | 70° | 1:1 | −10.5° |
| 5H | 0° | 90° | 1:1 | −13.5° |
| 5I | 0° | 110° | 1:1 | −17° |

Figure 6B:
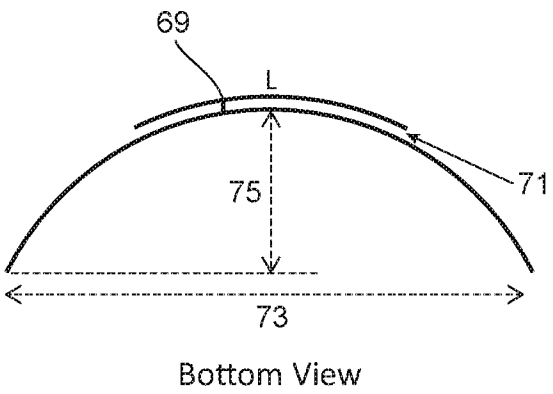
FIGS. 6A and 6B depict another exemplary embodiment of a patch antenna of the present disclosure.
Figure 6A:
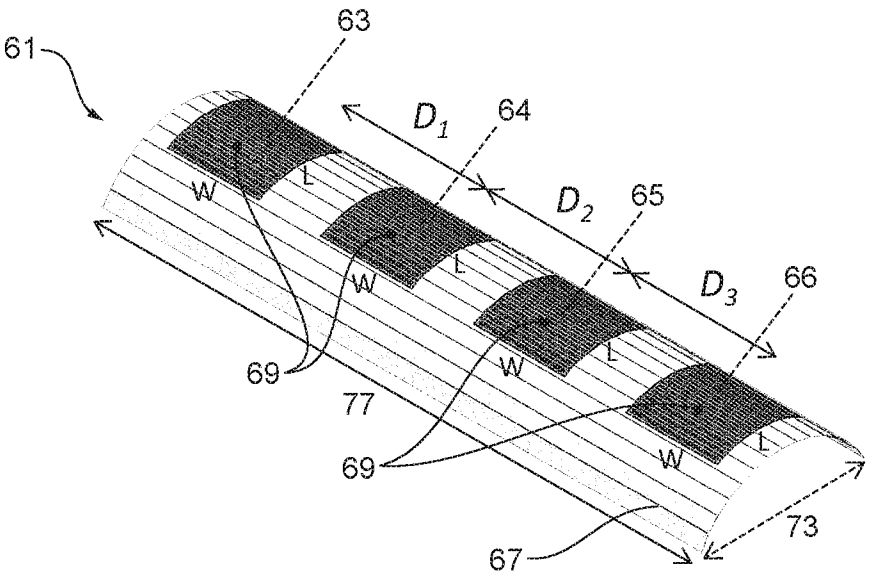

FIG. 6A depicts one embodiment of the present disclosure. In this embodiment, there is provided a curved antenna 61 comprising four curved patches 63, 64, 65, 66 on a curved ground plane 67. Each of the four curved patches 63, 64, 65, 66 is connected to respective individual feed point 69 into a feeding network (not shown in FIG. 6A). FIG. 6B depicts a bottom view of the embodiment of FIG. 6A. Between each of the four curved patches 63, 64, 65, 66 and the curved ground plane 67, there is a layer of substrate 71.

In this example, each patch is measured 141.34 mm (L)×149 mm (W). The distances between every two curved patches, $D_1$, $D_2$, $D_3$ are 250 mm. The substrate 71 is an air substrate of 7 mm thickness. The side edge 77 of the curved ground plane is 980 mm. When bent into a curve, the distance 73 between the two side edges is 267.3 mm. The distance 75 between the peak of the curve and the base is 81.9 mm.

Figure 7:
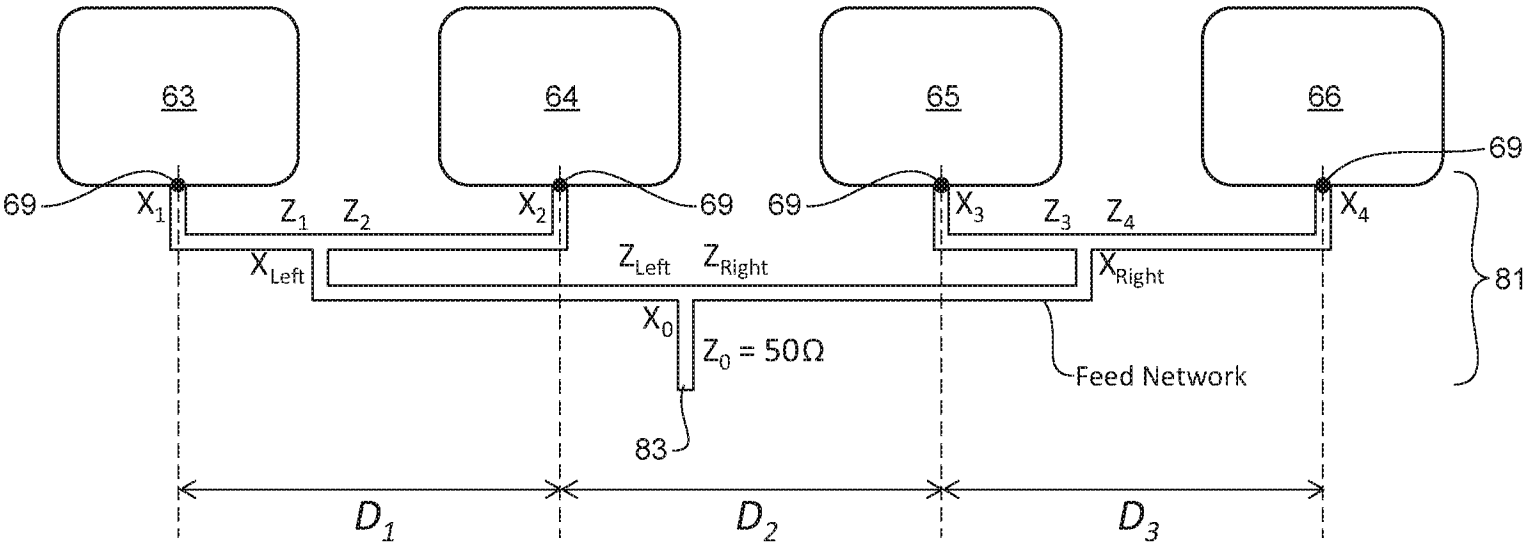
FIG. 7 shows an exemplary feed network for the embodiment of FIG. 6A.

FIG. 7 shows an exemplary feed network (microstrip line feed network) for the embodiment of FIG. 6A. In this example, the feed network 81 is between the individual feed points 69 and antenna feed 83. Antenna feed 83 usually have a characteristic impedance $Z_0$ of 50Ω.

Figure 8:
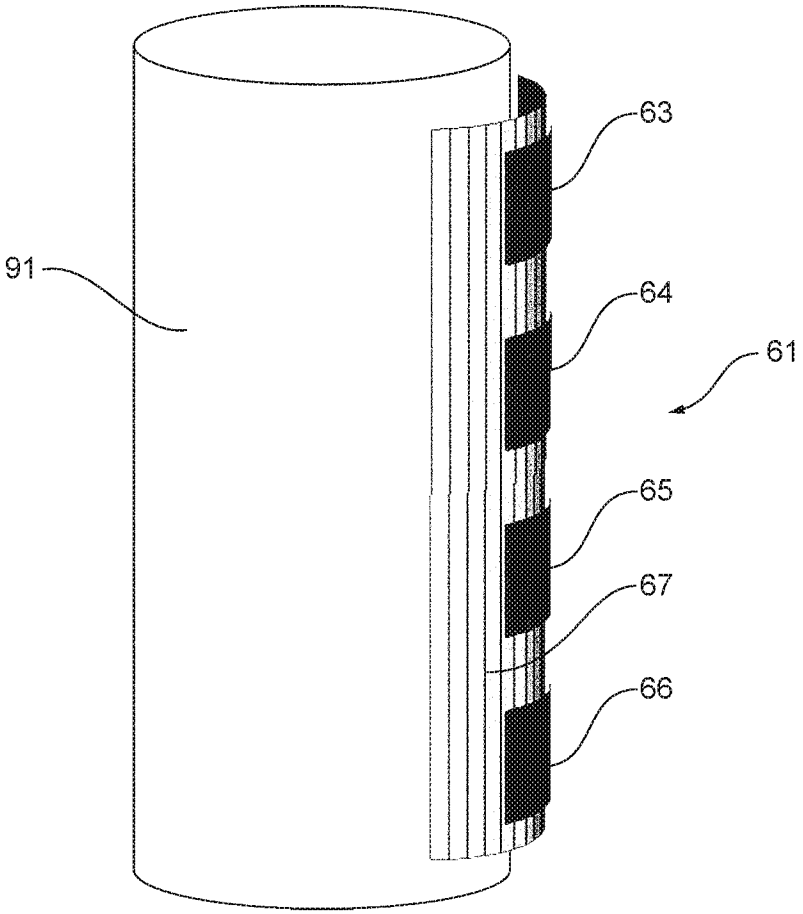
FIG. 8 depicts an application of the curved antenna of FIG. 6A.

With proper design of the following parameters, the curved antenna can be keep straight upright while offering tilting and a directional radiation pattern:

a. phase difference ($\phi_1-\phi_2$, $\phi_2-\phi_3$, $\phi_3-\phi_4$) depends on the path length difference $X_0X_1-X_0X_2$, $X_0X_2-X_0X_3$, and $X_0X_3-X_0X_4$;

b. power ratio ($P_1:P_2:P_3:P_4$) depends on the ratio of all characteristics Z ($Z_1$, $Z_2$ at $X_{Left}$; $Z_3$, $Z_4$ at $X_{Right}$, $Z_{Left}$, $Z_{Right}$ at $X_0$); and c. spacing of radiation elements: $D_1$, $D_2$, $D_3$ FIG. 8 depicts an application of the curved antenna of FIG. 6A on a column where the curved antenna is mounted at a curved side of a column. In this example, the column is a vertical column 91. In such a case, the curved antenna 61 is positioned perpendicularly to the Earth plane with its curved patches 63, 64, 65, 66 and curved ground plane 67 also positioned perpendicularly to the Earth plane.

FIG. 9 shows the curved antenna 61 of FIG. 6A, and provides a reference angle, β, 101 and a reference line 103. The reference line 103 is orthogonal to the ground plane 67 of the curve antenna 61. The reference angle, β, 101 refers to the angle of the main radiation of the curved antenna relative to the reference line 103. For simplicity, a direction below the reference line 103 is considered to be a negative angle in the following examples.

Figure 10D:
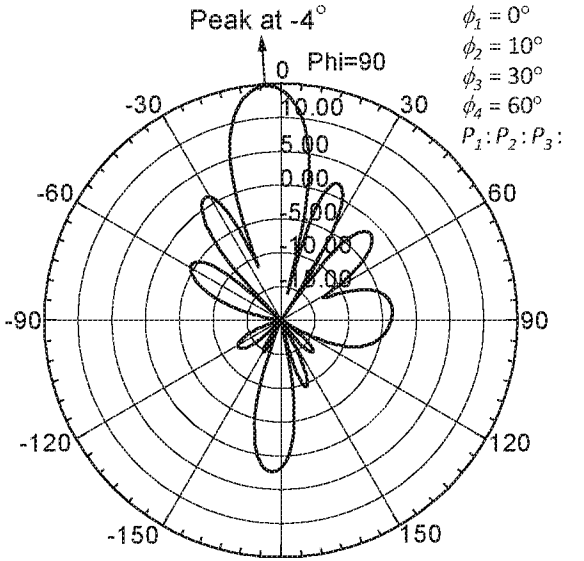
Figure 10E:
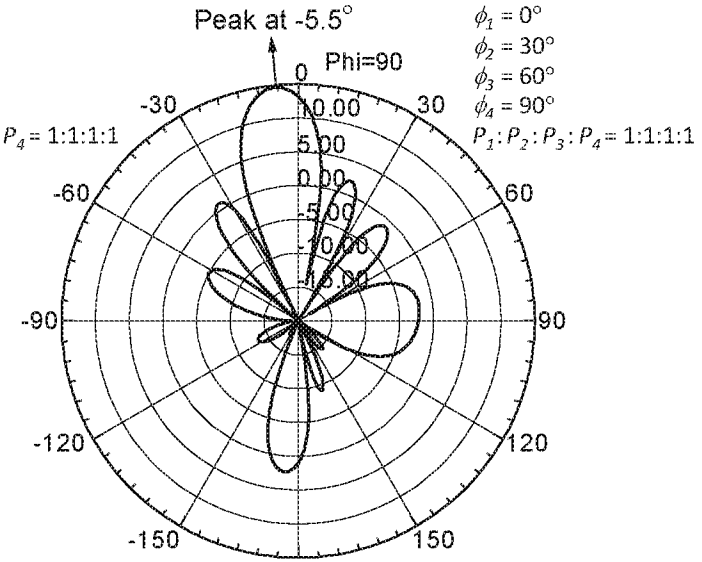
Figure 10F:
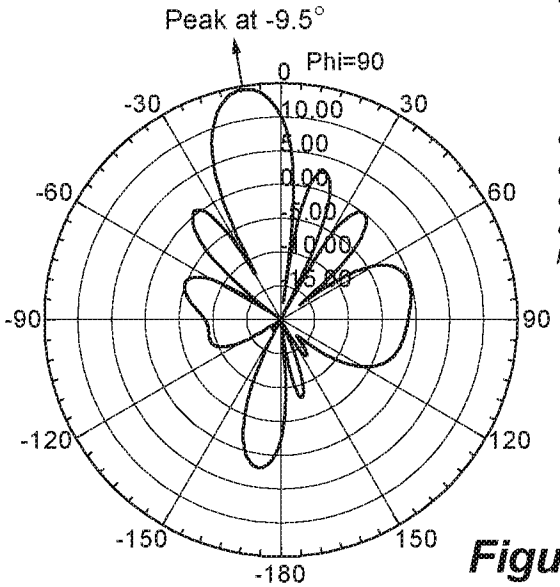

FIGS. 10A to 10F present simulated results of a 2D radiation pattern at a vertical plane with the reference line 103 falling along the vertical plane. Note that in those simulated results, the top direction corresponds to the direction of the reference line 103. FIG. 10A shows that when $\phi_1=\phi_2=\phi_3=\phi_4=0°$, and that $P_1:P_2:P_3:P_4=1:1:1:1$, the main directional radiation is at 0° with relative to the reference line 103, i.e. there is no electrical tilting. FIG. 10B shows that when $\phi_1=0°$, $\phi_2=10°$, $\phi_3=20°$, $\phi_4=30°$, and that $P_1:P_2:P_3:P_4=1:1:1:1$, the main directional radiation is at −2° with relative to the reference line 103, i.e. there is an electrical tilting of 2° towards the Earth plane.

The results of 10C to 10F, together with the results of 10A and 10B are summarised in the table below:

| FIG. | $\phi_1$ | $\phi_2$ | $\phi_2$ | $\phi_2$ | $P_1:P_2:P_3:P_4$ | β |
|---|---|---|---|---|---|---|
| 10A | 0° | 0° | 0° | 0° | 1:1:1:1 | 0° |
| 10B | 0° | 10° | 20° | 30° | 1:1:1:1 | −2° |
| 10C | 0° | 20° | 40° | 60° | 1:1:1:1 | −4° |
| 10D | 0° | 10° | 30° | 60° | 1:1:1:1 | −4° |
| 10E | 0° | 30° | 60° | 90° | 1:1:1:1 | −5.5° |
| 10F | 0° | 40° | 90° | 150° | 1:1:1:1 | −9.5° |

Further, the directional radiation is designed to be narrower in beamwidth in a vertical plane than in a horizontal plane. This is particularly useful in the application in an ETC system.

Figure 14:
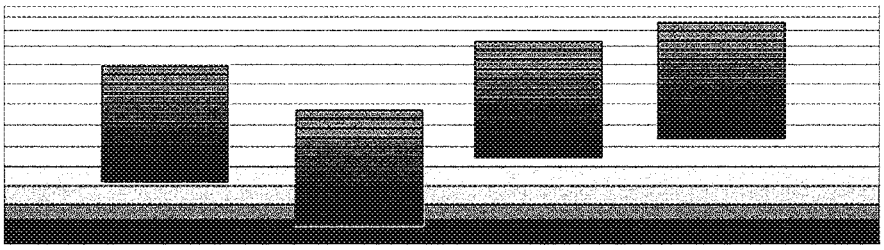
FIGS. 11 to 14 show different embodiments of the present disclosure.
Figure 13:
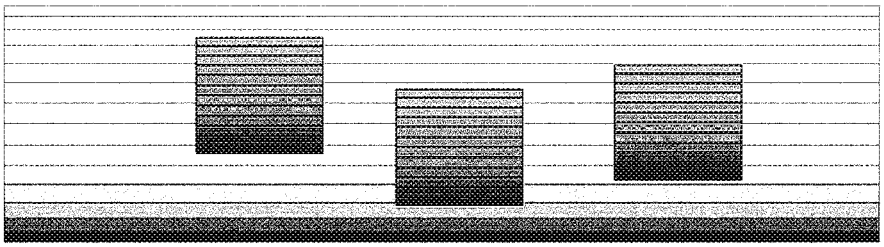
Figure 12:
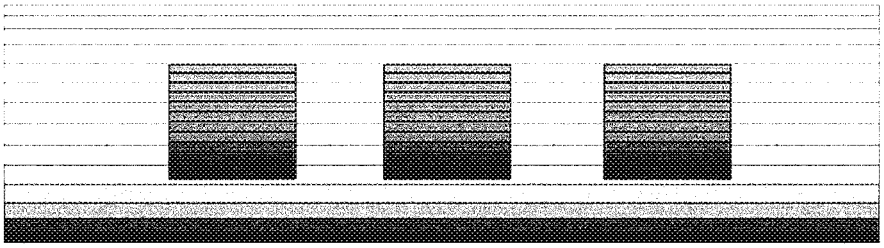
Figure 11:
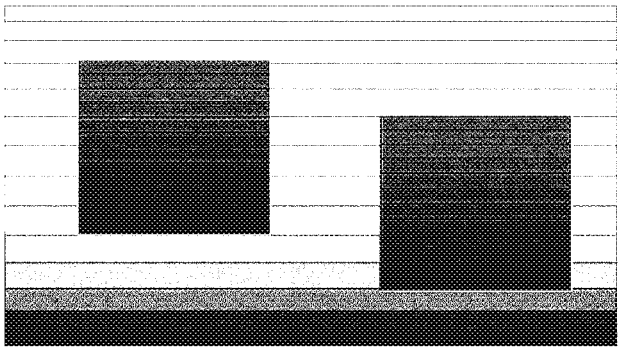

FIGS. 11 to 14 show different embodiments of the present disclosure. In particular, FIG. 11 shows an embodiment where there are two radiating elements (taking the form of patches) on top of the curve ground, and that the two patches are offset from each other. FIG. 12 shows an embodiment where there are three radiating elements (taking the form of patches) on top of the curve ground, and that the three radiating elements are lined up vertically along the longitudinal direction along a post or a column. FIG. 13 shows an embodiment where there are three radiating elements (taking the form of patches) on top of the curve ground, and that the three patches are offset from each other. FIG. 14 shows an embodiment where there are four radiating elements (taking the form of patches) on top of the curve ground, and that the four patches are offset from each other.

Figure 15A:
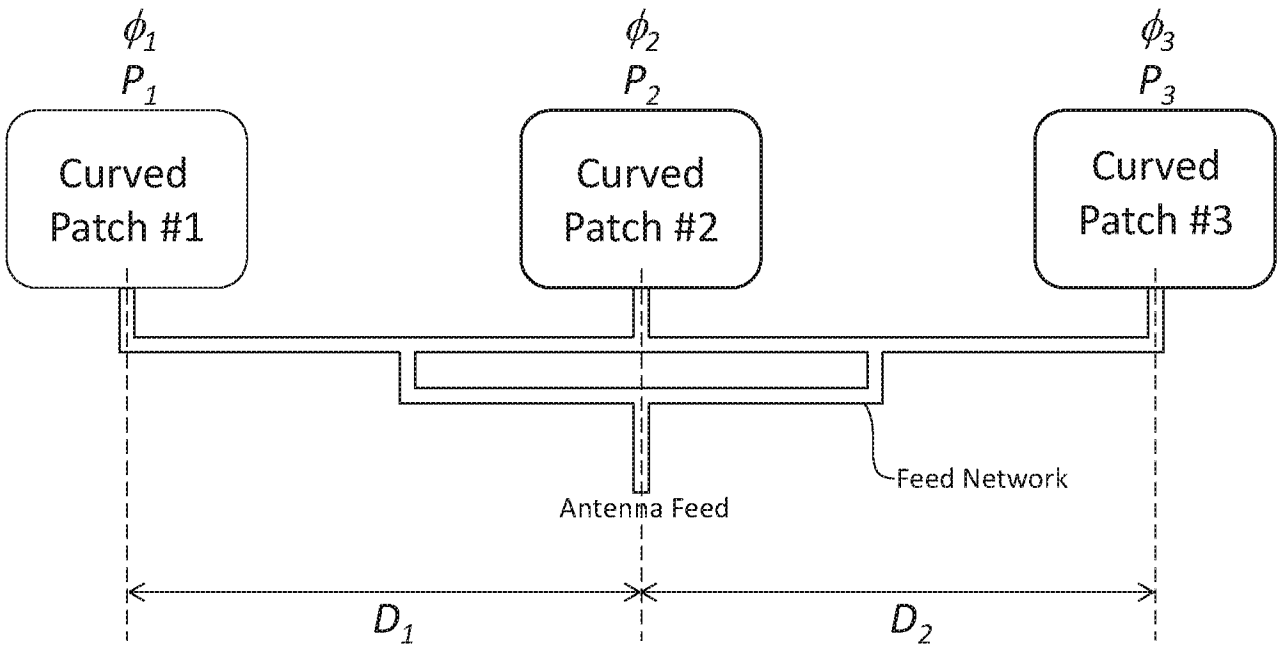
FIGS. 15A and 15B show two different ways to design a feed network.
Figure 15B:
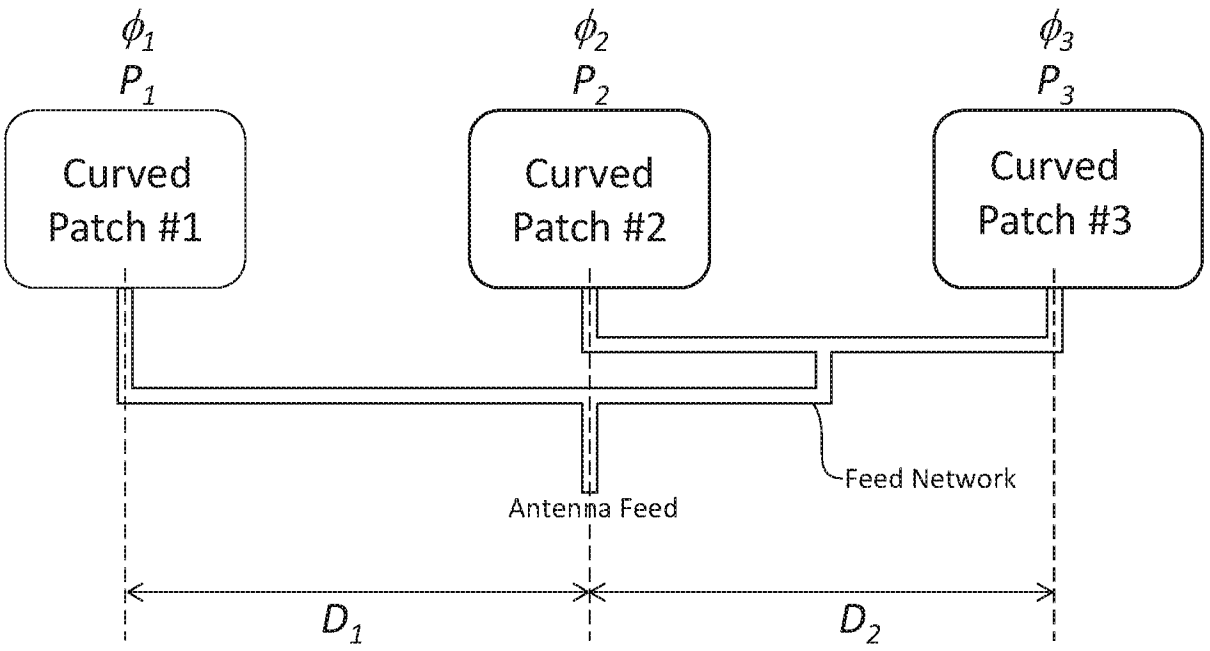

FIGS. 15A and 15B show two different ways to design a feed network for a curve antenna with three radiating elements (taking the form of patches) on top of the curve ground. The same idea can be extended to the case where there are more than three radiating elements.

Figure 16B:
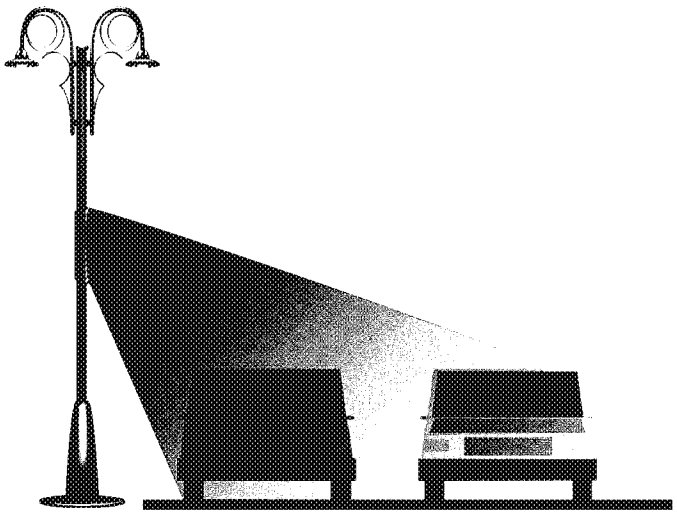
FIGS. 16A and 16B show an exemplary application of a curved antenna as the interrogating antenna of an RFID reader.
Figure 16A:
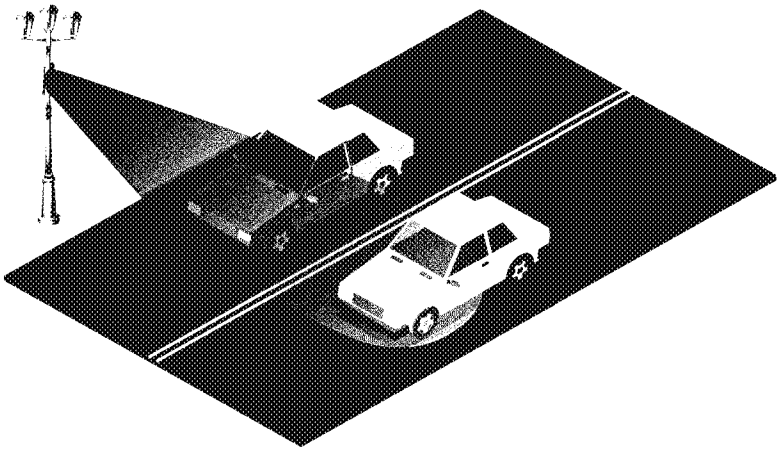

FIGS. 16A and 16B show an exemplary application of a curved antenna as the interrogating antenna of an RFID reader on roadside. In this example, a curved antenna is mounted on a lamp post upright with a down-tilted radiation pattern covering a predefined area. Any vehicle with an RFID tag or transponder (with proper protocol and polarization) within the predefined area would be detected or read by the RFID reader through its interrogating antenna mounted on the lamp post. In one embodiment, the directional curved antenna is also adjustable by mechanical means with respect to the lamp post.

Figures 17A, 17B:
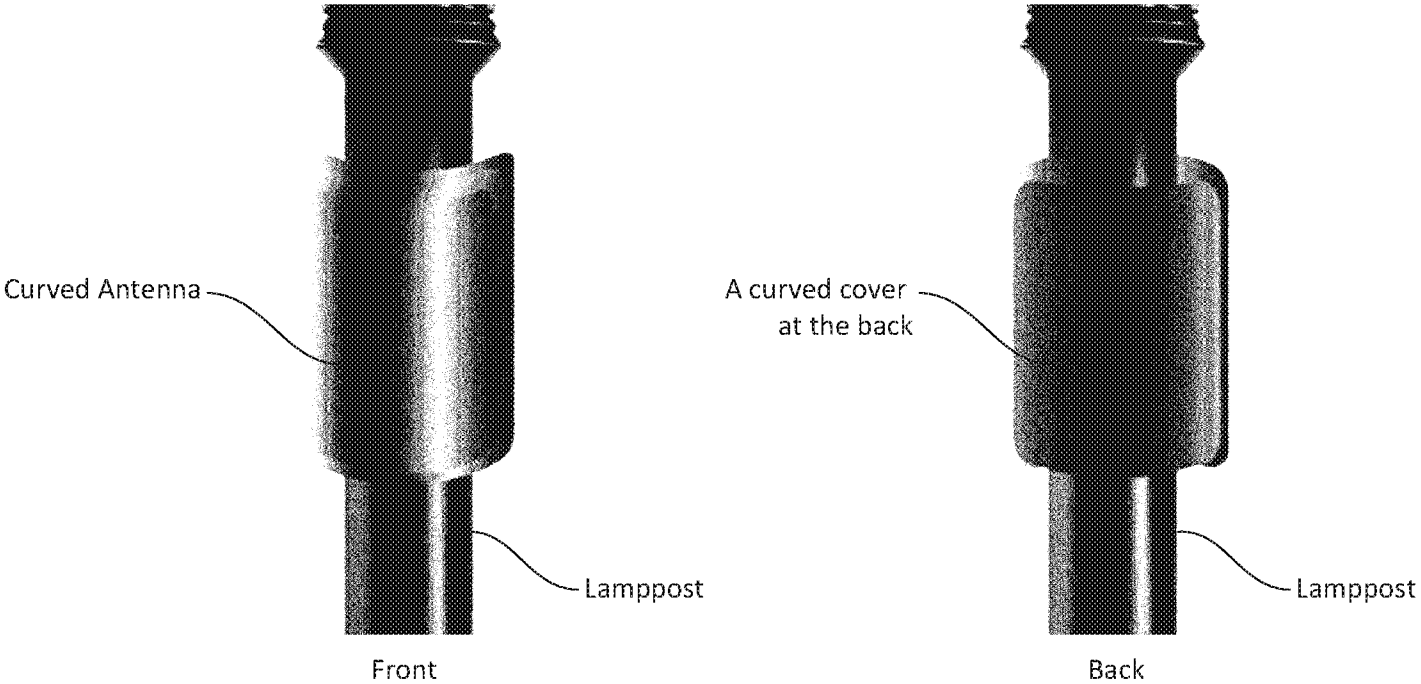
FIG. 17A depicts a curved antenna with a curved radome for covering the feed network, the curved ground plane, and the at least two radiating elements.
FIG. 17B shows an exemplary cover at the back of the curved antenna of FIG. 17A.

FIG. 17A depicts a curved antenna with a curved radome for covering the feed network, the curved ground plane, and the at least two radiating elements. In this example, the curved radome is designed to resemble the post that it is mounted on to provide an inconspicuous effect to the curved antenna. FIG. 17B shows an exemplary cover at the back of the curved antenna to provide a further inconspicuous effect of the whole structure.

In another embodiment, at least two of the radiating elements of the curved antenna are adjustable in position to adjust the separation between them, thereby adjusting the radiation direction and the performance of the curved antenna. This can be done in combination with the adjustment of the feed network as described previously, for example with reference to FIGS. 5A to 5I, to adjust the tilt angle of a main beam of the directional radiation.

The present disclosure has the following advantages over known prior art:

The present disclosure utilises electrical tilting in curved antenna structure. Instead of tilting of the antenna mechanically, the antenna is able to provide directional radiation tilted vertically in the elevation plane (oppose to azimuth plane), while the whole antenna structure remains straight upright along the lamppost. Without mechanical tilting, the design of a mounting bracket is simple, cost effective, easy and safe for installation. Also, a straight upright mounting position can be more secure and stable to severe weather. This may increase the integrity of the antenna against physically damage and increase the life span of the antenna; and reduce the risk of the antenna being impacted by an external force. Further, an antenna according to the present disclosure can be mounted on an existing structure such as a lamp post or traffic light post. It is not necessary to erect new structures such as gantries and cantilevers for mounting antennas. This saves deployment costs and time.

Aesthetically, the simple mounting structure of a curved antenna according to the present disclosure which provides electrical tilting of the directional radiation allows an unobtrusive (or inconspicuous) design for mounting, for example on a lamp post. This may improve the scenery of the roadside in a city, rather than having obvious artificial structures everywhere.

In terms of radiation, when the antenna is mounted vertically, it provides extra benefits that the radiation pattern is with wide horizontal beamwidth (in the azimuth plane)

and with narrow vertical beamwidth (in the elevation plane). This is particularly useful in the field of an ETC system, or vehicle/traffic management.

In the case of a curved patch antenna, curving the ground plane effectively increases the substrate thickness, thus potentially enhancing the performance of the curved patch antenna with proper patch antenna design.

Throughout the specification and the claims that follow, unless the context requires otherwise, the words "comprise" and "include" and variations such as "comprising" and "including" will be understood to imply the inclusion of a stated integer or group of integers, but not the exclusion of any other integer or group of integers.

The reference to any prior art in this specification is not, and should not be taken as, an acknowledgement or any form of suggestion that such prior art forms part of the common general knowledge.

It will be appreciated by those skilled in the art that the invention is not restricted in its use to the particular application described. Neither is the present invention restricted in its preferred embodiment with regard to the particular elements and/or features described or depicted herein. It will be appreciated that the invention is not limited to the embodiment or embodiments disclosed, but is capable of numerous rearrangements, modifications and substitutions without departing from the scope of the invention as set forth and defined by the following claims.

The invention claimed is:

1. A passive directional curved antenna, comprising:

a feed network;

a curved ground plane positioned perpendicularly to an Earth plane;

at least two radiating elements connected to the feed network above the curved ground plane, wherein the at least two radiating elements are arranged and configured such that the passive directional curved antenna provides a directional radiation, the directional radiation is with its main beam directed towards the Earth plane to cover a selected RFID detection area by controlling parameters comprising (i) phase differences between the at least two radiating elements, wherein the phase differences are controlled through a positioning of an intersection $X_0$ of two branches in the feed network, wherein the two branches are connected to the at least two radiating elements respectively; (ii) power differences between the at least two radiating elements, wherein the power differences are controlled through a power ratio of $P_1/P_2$ which depends on a ratio of $Z_2/Z_1$ at the intersection $X_0$ where $P_1$, $P_2$ are respective power of the at least two radiating elements, $Z_1$, $Z_2$ are respective impedances of the two branches at the intersection $X_0$ towards $X_1$ and towards $X_2$, where $X_1$, $X_2$ are respective individual feed point of the at least two radiating elements and $X_0$ to $X_1$ and $X_0$ to $X_2$ define lengths of the two branches; and (iii) element to element spacing(s) between the at least two radiating elements, wherein the element to element spacing(s) are controlled through a positioning of $X_1$ and $X_2$.

2. The passive directional curved antenna of claim 1, wherein the passive directional curved antenna is mounted at a curved side of a column.

3. The passive directional curved antenna of claim 2, wherein the curved ground plane follows the curvature of the curved side of the column.

4. The passive directional curved antenna of claim 2, wherein the at least two radiating elements are arranged longitudinally along the column.

5. The passive directional curved antenna of claim 1, wherein the at least two radiating elements are on a same plane and positioned perpendicularly to the Earth plane.

6. The passive directional curved antenna of claim 1, wherein the at least two radiating elements are curved radiating elements.

7. The passive directional curved antenna of claim 1, wherein the at least two radiating elements are positioned at different altitudes with respect to an Earth plane.

8. The passive directional curved antenna of claim 7, wherein the directional radiation is narrower in beamwidth in a vertical plane than in a horizontal plane.

9. The passive directional curved antenna of claim 1, further comprising a curved radome for covering the feed network, the curved ground plane, and the at least two radiating elements.

10. The passive directional curved antenna of claim 9, wherein the curved radome provides an inconspicuous effect to the passive directional curved antenna.

11. The passive directional curved antenna of claim 1, further comprising an adjusting mechanism for adjusting a tilt angle of a main beam of the directional radiation of the passive directional curved antenna.

12. The passive directional curved antenna of claim 1, wherein the passive directional curved antenna is adjustable with respect to a structure of the passive directional curved antenna is mounted on.

13. The passive directional curved antenna of claim 1, wherein the at least two radiating elements are adjustable in position to adjust the separation between them.

14. The passive directional curved antenna of claim 1, wherein the feed network provides phase differences, or power differences, or both, between the at least two radiating elements.

15. The passive directional curved antenna of claim 1, wherein a tilt angle of a main beam of the directional radiation is adjustable by adjusting the feed network, or a relative position of the at least two radiating elements, or both.

16. The passive directional curved antenna of claim 1, further comprising a substrate between the curved ground plane and the at least two radiating elements, wherein the curved ground plane increases an effective thickness of the substrate as compared with a flat ground plane.

* * * * *